United States Patent [19]

Teng

[11] 4,036,237

[45] July 19, 1977

[54] SMOKING COMPOSITION

[75] Inventor: Lina Chen Teng, Richmond, Va.

[73] Assignee: Philip Morris Incorporated, New York, N.Y.

[21] Appl. No.: 659,691

[22] Filed: Feb. 20, 1976

[51] Int. Cl.[2] ..... A24B 15/04

[52] U.S. Cl. ..... 131/17 R; 131/144

[58] Field of Search ..... 131/2, 17, 144; 260/340.5, 473 R, 521 R

[56] References Cited

PUBLICATIONS

*Perfume and Flavor Chemicals,* vol. II by Arctander, published by the author Montclair, N.Y. in 1969.

*Primary Examiner*—Robert W. Michell
*Assistant Examiner*—V. Millin

[57] ABSTRACT

A smoking composition is provided which comprises a smoking material and, as a source of flavor or aroma for the smoke thereof, certain aromatic beta-hydroxy compounds. Compounds which may be employed as a source of flavor or aroma include beta-hydroxy esters formed by condensing, using a Reformatsky-type reaction, an alkyl alpha-bromo-isobutyrate or homolog thereof with an aromatic aldehyde such as benzaldehyde, anisaldehyde or piperonal. Other compounds which may be employed are the acids and/or metal salts which are formed by hydrolysis of such beta-hydroxy esters. Novel compositions of matter provided by the present invention include: the compound ethyl 2,2-dimethyl-3-hydroxy-3-(3',4'-methylenedioxyphenyl)-propionate, the compound n-amyl 2,2-dimethyl-3-hydroxy-3-phenylpropionate, the compound methyl 2,2-dimethyl-3-hydroxy-3-phenylpropionate, the compound 2,2-dimethyl-3-hydroxy-3-(3',4'-methylenedioxy phenyl) propionic acid, the compound ethyl 2,2-dimethyl-3-hydroxy-3-(p-methylphenyl)propionate, and the compound ethyl 2,2-dimethyl-3-hydroxy-5-phenyl-trans-4-pentenoate. The invention enables the incorporation in smoking materials, and particularly in tobacco, of compounds which will release flavors or aromas which compounds can be maintained and preserved during subsequent processing and storage of the tobacco.

5 Claims, No Drawings

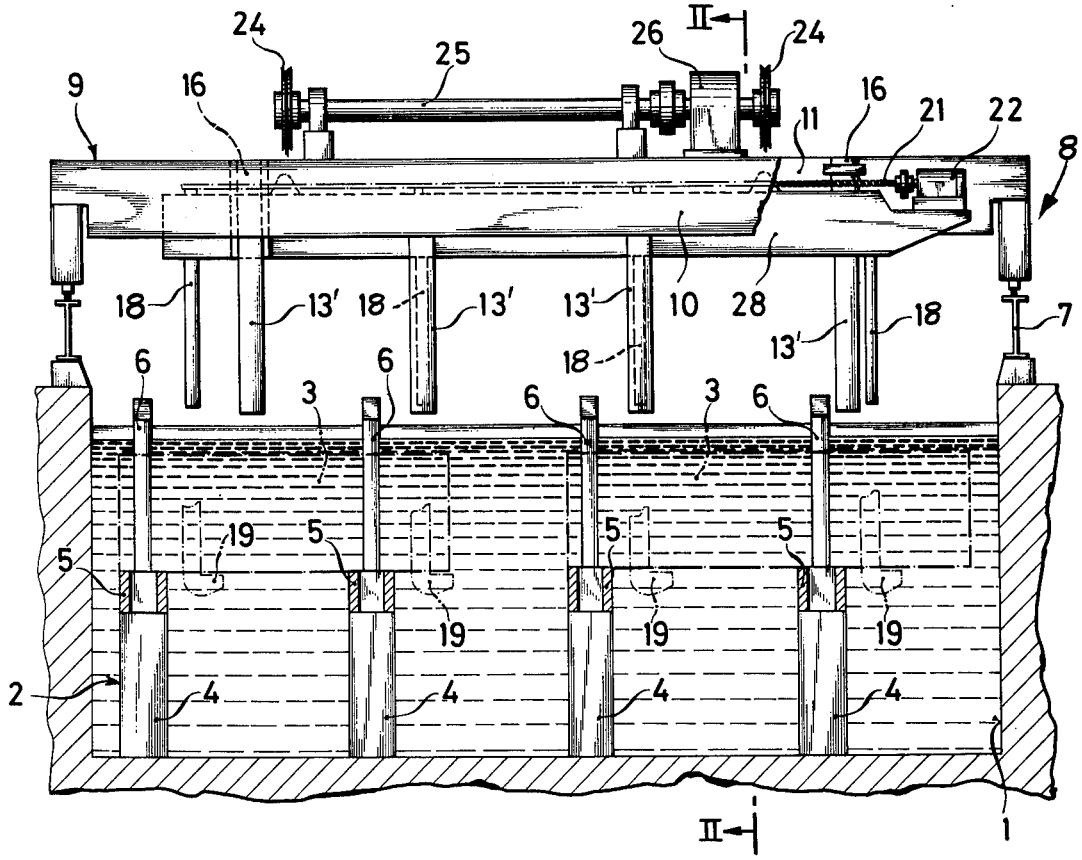

SMOKING COMPOSITION

BACKGROUND OF THE INVENTION

In the manufacture of smoking products made from tobacco, the nature of the flavor and aroma produced by a smoking product has always been an important consideration. When a tobacco product has been prepared, one method for achieving desired flavor and aroma has involved the blending of various types of tobaccos. This method, however, can obviously be a complex and costly one and may still not provide a desired effect of flavor or aroma. For example, blending tobaccos from various parts of the world may still not provide a desired, fruity or cherry-like flavor in a smoking product. Accordingly, it has been common practice for many years in the tobacco art to add materials to tobacco products to modify the flavor or aroma thereof.

Many methods of adding flavors or aromas to tobacco smoke are known. However, the known methods have not been found to be completely satisfactory and have not been found to provide effective means for incorporation of specifically desired flavors or aromas in tobacco smoke, for example, cherry-like or fruity flavors.

When certain flavorful aldehydes per se are added to tobacco to make flavored smoking products, the loss of such aldehydes during the manufacturing process and during storage is very high, due to their relatively volatile nature. In addition to the undesirable loss of such materials, objectionable vapors may be encountered in the actual manufacturing process or during the storage of the resulting products prior to their use.

Certain alkyl esters of beta-methyl valeric acid have been taught as imparting a fruity, apple-like aroma and a nut-like flavor when incorporated in tobacco, as is set forth in U.S. Pat. No. 3,782,391. However, as is pointed out in U.S. Pat. No. 3,854,485, such materials are relatively volatile substances with low odor threshold values which make them difficult substances to use in flavoring tobacco because of the problem of evaporation on prolonged storage of the treated tobacco. The monoesters of mono- and/or dialkyl malonates, which are taught as tobacco flavorants in U.S. Pat. No. 3,854,485 are said to produce a smoke flavor characterized by a fermented apple-peel with an English walnut-like taste. Such materials, however, provide only a limited form of flavor enhancement in tobacco products.

When flavorants are adsorbed on an absorbent, such as activated charcoal or fuller's earth, and applied to tobacco, the yield of flavor when such tobacco is smoked has been found to be very low. In addition, such a process results in the incorporation in the tobacco of a foreign material which can give an undesirable appearance to the tobacco and which can result in uneven burning of the tobacco.

The incorporation in tobacco of flavorants in the form of clathrates has been not only expensive but has also been found to be inefficient, since the yield of flavor when tobacco containing such clathrates is burned has been found to be very low.

Certain esters, for example, menthol succinate or menthol borate, have also been prepared and added to tobacco. However, the yield of flavorant when the tobacco product containing such succinates or borates is smoked has also been found to be very low.

The present invention provides for the incorporation in tobacco or other smoking material of a compound which will impart cherry-like or fruity flavors to the smoke thereof, which compound is not lost during manufacturing and storage and which compound is readily released when the tobacco is smoked. If desired, more than one flavorant may, in accordance with the invention be simultaneously incorporated in the tobacco or other smoking material.

It is an object of this invention to permit the incorporation of a flavor into a tobacco product, which flavor will not be lost or altered during subsequent manufacturing steps or during storage of the tobacco product.

It is a further object of this invention to permit the incorporation of a material in tobacco, which material will release one or more flavorants into the tobacco smoke which results when the tobacco containing said material is smoked.

It is a further object of the present invention to control the amount of flavor or flavors released during the smoking of a tobacco product to insure uniformity of flavor during the entire smoking process.

It is a still further object of the present invention to provide a flavoring composition which is uniquely suited for use in tobacco products.

One of the more specific objects of the present invention is to incorporate cherry-like or fruity flavors in a tobacco product in such a manner than they will not be released prior to the time that the tobacco product is smoked but will be readily and efficiently released as the tobacco product is smoked.

Another of the more specific objects of the present invention is to incorporate an additive in tobacco which, when the tobacco is smoked, will not only release cherry-like or fruit-like flavor but will also release one or more additional flavorants.

A still further object of this invention is a composition and method for incorporating in tobaccos, smoking materials, including natural reconstituted tobaccos and tobacco substitutes, flavors or aromas which may be desired and which may be lacking in said smoking materials.

BRIEF SUMMARY OF THE INVENTION

A smoking composition is provided which comprises a smoking material and, as a source of flavor or aroma for the smoke thereof, certain aromatic beta-hydroxy compounds. Compounds which may be employed as a source of flavor or aroma include beta-hydroxy esters formed by condensing, using a Reformatsky-type reaction, an alkyl alpha-bromoisobutyrate or homolog thereof with an aromatic aldehyde such as benzaldehyde, anisaldehyde or piperonal. Other compounds which may be employed are the acids and/or metal salts which are formed by hydrolysis of such beta-hydroxy esters. Novel compositions of matter provided by the present invention include: the compound ethyl 2,2-dimethyl-3-hydroxy-3-(3',4'-methylenedioxyphenyl)-propionate, the compound n-amyl 2,2-dimethyl-3-hydroxy-3-phenylpropionate, the compound methyl 2,2-dimethyl-3-hydroxy-3-phenylpropionate, the compound 2,2-dimethyl-3-hydroxy-3-(3',4'-methylenedioxy phenyl) propionic acid, the compound ethyl 2,2-dimethyl-3-hydroxy-3-(4'-methylphenyl)propionate, and the compound ethyl 2,2-dimethyl-3-hydroxy-5-phenyl-trans-4-pentenoate. The invention enables the incorporation in smoking materials, and particularly in tobacco, of compounds which will release flavors or aromas which compounds can be maintained and preserved during subsequent processing and storage of the tobacco.

DETAILED DESCRIPTION OF THE INVENTION

In accordance with the present invention, an aromatic beta-hydroxy compound is incorporated in a smoking product, particularly a tobacco product. The aromatic beta-hydroxy compound may be incorporated in the wrapper of the smoking product but is most preferably incorporated in the filler of the smoking product, which, in the case of cigarettes would be in the shredded tobacco employed therein.

The amount of beta-hydroxy compound employed in the smoking product should be at least 0.0001 percent by weight, and will generally comprise from about 0.0001 to about 0.1 percent by weight, based on the total amount of smoking material which is present, although higher amounts might be employed, if desired. Preferably from about 0.005 to about 0.05 percent by weight of the aromatic beta-hydroxy ester is employed, based on the total weight of smoking material present, particularly where the smoking material is tobacco. The amount will vary depending upon the particular compound of mixture of compounds to be employed.

The compounds of this invention may be incorporated in the smoking product at any stage of its manufacture. One or more of the present compounds may be added to the wrapper or to the tobacco at an early stage of its processing. Preferably, however, they are added to the shredded tobacco or other filler before it is formed into a smoking article. They may be added to only a portion of the smoking materials or may be added to all of the smoking materials, as well as to the wrapper.

The beta-hydroxy compounds which may be employed in the present invention may be represented by the following formula:

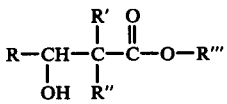

wherein R may be a member selected from the group consisting of:

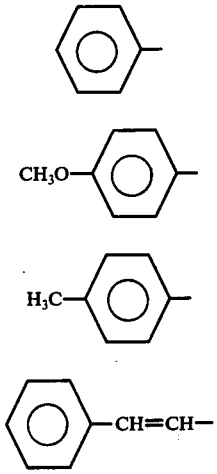

-continued

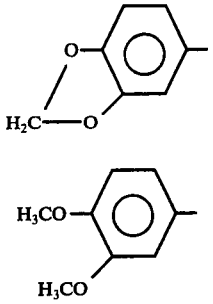

wherein R′ is a lower alkyl group, particularly methyl or ethyl; wherein R″ is a lower alkyl group, particularly methyl or ethyl; and wherein R‴ is a member selected from the group consisting of H, M, which may for example be an alkali metal such as sodium or potassium, and alkyl containing from 1 to 8 carbon atoms, for example, methyl, ethyl, n-propyl, isopropyl, n-butyl, sec.-butyl, isobutyl, tert.-butyl, n-amyl, n-hexyl, n-heptyl and n-octyl.

Preferred compounds of the present invention are the beta-hydroxy esters having the structure shown below:

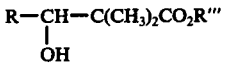

wherein R and R‴ have the values set forth earlier in this specification, for example: Compound A: Ethyl 2,2-dimethyl-3-hydroxy-3-phenylpropionate. The flavor and aroma imparted to smoking products by this compound may be described as sweet, cherry-like and aromatic.

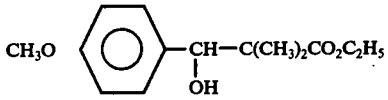

Compound B: Ethyl 2,2-dimethyl-3-hydroxy-3-(4′-methoxyphenyl)propionate. The flavor and aroma imparted to smoking products by this compound may be described as sweet, stronger aromatic and cherry-like.

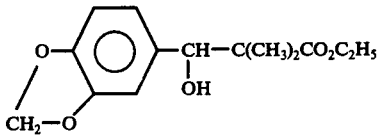

Compound C: Ethyl 2,2-dimethyl-3-hydroxy-3-(3′,4′-methylenedioxyphenyl)-propionate. The flavor and aroma imparted to smoking products by this compound may be described as sweet, strong aromatic, cherry-like, but slightly harsh.

The beta-hydroxy esters employed in the present invention may be prepared by means of a Reformatsky-type reaction. This may be generalized as follows:

-continued

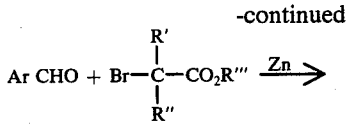

$$Ar\,CHO + Br-\underset{R''}{\overset{R'}{C}}-CO_2R''' \xrightarrow{Zn}$$

$$Ar-CH(OH)\underset{R''}{\overset{R'}{C}}-CO_2R'''$$

wherein R′ is a lower alkyl group, particularly methyl or ethyl; wherein R″ is a lower alkyl group, particularly methyl or ethyl; and wherein R‴ is a member selected from the group consisting of H, M, which may for example be an alkali metal such as sodium or potassium, and alkyl containing from 1 to 8 carbon atoms, for example, methyl, ethyl, n-propyl, isopropyl, n-butyl, sec.-butyl, isobutyl, tert.-butyl, n-amyl, n-hexyl, n-heptyl and n-octyl.

Hydroxy acids or salts may also be utilized where specific flavor modifications are desired. These compounds tend to reduce harshness and impart to the tobacco product a note reminiscent of Turkish tobacco.

The hydroxy acids or metal salts thereof may be prepared from the corresponding esters by conventional hydrolysis reactions. For example, 3-phenyl-3-hydroxy-2,2-dimethylpropionic acid, a known compound, may be prepared by reacting the corresponding ethyl ester with water in the presence of barium hydroxide, followed by neutralization with hydrochloric acid.

In addition to the benzaldehyde, anisaldehyde and piperonal which may be employed as the aromatic aldehydes, there may also be employed para-methylbenzaldehyde cinnamaldehyde, veratraldehyde and homologs and analogs of these compounds.

The compounds of the present invention and particularly the esters have markedly lower vapor pressures than the parent aldehydes and, as a consequence, remain in place in the smoking article without significant loss or migration. The compounds of the present invention undergo pyrolysis at relatively mild temperatures generally at about 250°–330° C., primarily to regenerate the aldehyde and ethyl isobutyrate as illustrated by reaction (a) in Equation I set forth below. During pyrolysis of a smoking product, there is little interference from side reactions and the products are released before they or the hydroxy ester is subject to combustion.

An alternative pyrolysis route for beta-hydroxy esters is dehydration to give principally the alpha, beta-unsaturated ester; in the present series of esters the alpha-dialkyl substitution blocks this route. Two competing pyrolysis routes are possible, however, as are set forth as routes (b) and (c) in Equation I. One possible reaction is ether formation through dimerization via dehydration at the hydroxyl, as illustrated in Equation I as route (b). The dimer ether has been identified from two of the esters. Another possible reaction is loss of hydroxyl and carbethoxy to produce the alkenyl aromatic, i.e., 1-aryl-2-methylpropene, as illustrated in Equation I as route (c).

Equation I

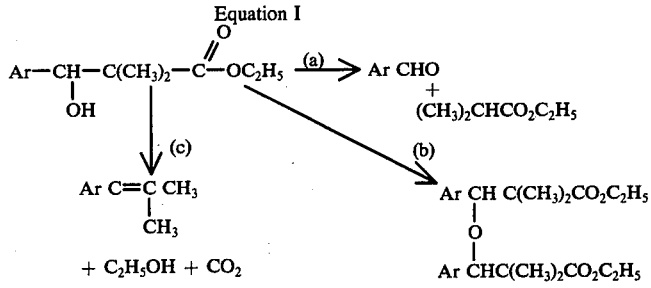

The aldehydes produced by the pyrolysis of the present compounds have distinctive, pleasing aromas generally characterized as cherry-like or fruity. In the case of the esters, the simultaneous generation of ethyl isobutyrate supplements the aroma with another pleasing note.

The synthesis of the general class of beta-hydroxy esters by way of the Reformatsky-type reaction is well known; see, for example, R. L. Shriner, Organic Reactions, Vol. 1, pp. 1-37, John Wiley & Sons, Inc., New York (1942). This gives reference to preparation of Compound A: Dain, J. Russ. Phys. Chem. Soc. 28, 159 (1896); see also Beilstein 10, 277. Compound B is found in Beilstein 10, 434. Compound C has not been found in the literature. The properties and analytical results identifying the compounds are given in the following Table:

Table I

| | Compound A | Compound B | Compound C |
|---|---|---|---|
| M.p. found | 39° C. | 73–75° C. | |
| lit. | 39° | 71° | — |
| B.p./mm Hg | — | — | 130°/0.025 |
| % C found | 70.46 | 66.55 | 62.93 |
| calcd. | 70.24 | 66.64 | 63.14 |
| % H found | 8.23 | 8.09 | 6.96 |
| calcd. | 8.16 | 7.99 | 6.81 |

All of the above compounds were verified by IR, NMR and MS findings supplemented in the case of Compound B by the UV spectrum.

In addition to Compounds A, B, and C, the following new compounds have been found to be effective, in accordance with the present invention:

Compound D: 2,2-dimethyl-3-hydroxy-3-(3′,4′-methylenedioxy phenyl) propionic acid. The flavor and aroma imparted to smoking products by this compound may be described as anise like in character.

Compound E: ethyl 2,2-dimethyl-3-hydroxy-5-phenyl-trans-4-pentenoate.

Compound F: methyl 2,2-dimethyl-3-hydroxy-3-phenyl propionate. The flavor and aroma imparted to smoking products by this compound may be described as having a fruity flavor.

Compound G: n-amyl 2,2-dimethyl-3-hydroxy-3-phenylpropionate.

Compound H: ethyl 2,2-dimethyl-3-hydroxy-3-(p-methylphenyl)-propionate.

In addition to the above, the following old compounds have been found to be effective, in accordance with the present invention:

Compound J: 3-phenyl-3-hydroxy-2,2-dimethylpropionic acid. The flavor and aroma imparted to smoking products by this compound may be described as full flavored.

Compound K: ethyl 2,2-dimethyl-3-hydroxy-3-(4'-methoxyphenyl)-propionate.

Compound L: 2,2-dimethyl-3-hydroxy-3-(4'-methoxyphenyl)-propionic acid. The flavor and aroma imparted to smoking products by this compound may be described as having a mild, sweet aromatic note.

Compound M: ethyl 2,2-dimethyl-3-hydroxy-3-phenylpropionate.

The following examples are illustrative:

EXAMPLE 1

Compound C was prepared as follows: A mixture of piperonal (9.2 g, 61 m mole), ethyl 2-bromoisobutyrate (10.0 g, 51 m mole), zinc dust (4.0 g, 61 m eq) and benzene (10 ml) was refluxed for six hours. After several days at room temperature, it was poured into 100 ml of water, acidified with dilute HCl and filtered. The filtrate was extracted with 3 × 50 ml of benzene. The extract was dried over anhydrous sodium sulfate and evaporated to 12.9 g of orange oil. The oil was distilled under reduced pressure:

| | | |
|---|---|---|
| (1) | 75–90°/0.1 m | about 1 g, mostly piperonal |
| (2) | 130–137°/0.075 mm | 8.0 g (58% yield calc. as Compound C) |

Redistillation at 0.025 mm gave product, b 130°.

EXAMPLE 2

Compounds A, B and C were applied to the filler in filter cigarettes. They were found to impart a pleasant flavor to mainstream smoke and a desirable added aroma to sidestream smoke. The flavor persisted in cigarettes smoked after 72 hr. storage in a cabinet at 100° C./15% r.h. Cigarettes treated with equivalent amounts of the aldehyde and ethyl isobutyrate had similar pleasant flavors and aromas, but after 72 hrs. storage they had lost substantially all of them.

Comparative tests were made with filter cigarettes to whose rods had been applied the three compounds. The three types of cigarettes were then smoked comparatively by an expert descriptive panel of five members.

| | |
|---|---|
| Cigarette containing Compound A | Approximately 250 ppm of Compound A applied to rod. |
| Cigarette containing Compound B | Approximately 250 ppm of Compound B applied to rod. |
| Cigarette containing Compound C | Approximately 200 ppm of Compound C applied to rod. |

The cigarettes containing Compound D were found to have the most aromatic cherry sidestream of the three. Cigarettes containing Compound C were found to have more overall harshness and throat harshness and to cause mouth coating, they gave a chemical note and were more green. Cigarettes containing Compound A were found to be more green than those with Compound B.

Cigarettes were made containing Compound B, where Compound B was applied to the rods of filter cigarettes at two levels, 283 ppm and 337 ppm, and these were compared with the untreated cigarette by panels of smokers.

Room aroma acceptability (i.e., sidestream comparison) was determined by placing lighted cigarettes in closed rooms and asking panelists to describe differences and state preference after sniffing. For the lower level, 32 of 37 panelists detected an aroma difference vs. the control but there was not a clear preference. For the higher level of flavorant, 36 of 40 detected a difference from the control and the treated cigarette was preferred with $P < 0.001$. The most common descriptors for that cigarette were "sweeter aroma" and "fruity." In booth smoking tests, both treated cigarettes were found sweeter than the control ($P < .001$), though the control in contrast with just the 283-ppm flavorant was judged more tobacco-like ($P < .001$) and was preferred ($P < .03$). Expert descriptive panelists found both treated cigarettes to have significantly more sweet aromatic and sweet basic than the control and to have a distinct cherry flavor (especially the 377-ppm cigarette).

EXAMPLE 3

Compound H: Ethyl 2,2-dimethyl-3-hydroxy-3-(4'-methylphenyl) propionate was synthesized from p-tolualdehyde by a procedure similar to that of Example 1. A mixture of p-tolualdehyde (72.1 g, 0.6 mole), ethyl 2-bromoisobutyrate (97.5 g, 0.5 mole), and benzene (100 ml) was added over a period of 80 minutes to zinc dust (39.2 g, 0.6 g-atom) under a nitrogen atmosphere, and the mixture was then refluxed for four hours. After addition of 100 ml more benzene, the cooled suspension was poured into ice-cold aqueous 10% sulfuric acid (200 ml) and filtered. Benzene washings of the filter were combined with the filtrate and the organic layer was washed with aqueous acid and water, then dried over anhydrous sodium sulfate and concentrated to a yellow liquid residue (135.8 g). Fractional distillation at reduced pressure gave four fractions; fraction 4 (b 80°–81.5°/0.01-0.02 mm) weighed 72 g and showed infra-red evidence of ester and hydroxy groups and NMR indication of good purity. Calculated as the expected hydroxy ester this represents a 61% yield. Further distillation produced a fraction b 77°–78.5°/0.013 mm which gave an analysis confirming $C_{14}H_{20}O_3$:

| | Calc. | Found |
|---|---|---|
| % C | 71.16 | 71.14 |
| % H | 8.53 | 8.89 |

This compound was applied to the paper wrapper of filter cigarettes as used in Example 2, at 0.5 mg/cigarette. Compound A was similarly applied at the same level to other specimens, and both were smoked by expert smokers, who also noted the sidestream odor during static burn to be sweet and fruity. The smokers rated Compound A cigarettes to be more intense in: sweet aromatic, sweet basic, aromatic "cherry" and "cherry" attributes.

EXAMPLE 4

Compound E: Ethyl 2,2-dimetyl-3-hydroxy-5-phenyl-trans-4-pentenoate was prepared by the Reformatsky reaction from trans-cinnamaldehyde by the scheme of Example 3. The quantity of all reagents was unchanged except that trans-cinnamaldehyde (79.3 g, 0.6 mole) replaced tolualdehyde. The crude liquid product weighed 132.4 g. Fractions 5 and 6 from distillation had strong IR bands for OH and ester, almost negligible aldehyde absorption; NMR analysis indicated 90 and 97% purity as the expected hydroxy ester. Yield was 51%.

The combined fractions were redistilled twice, the second time through a short-path semimicro still: fraction 3, b 103°-105°/0.01-0.02 mm, purity 95% by NMR. Elemental analysis confirms $C_{15}H_{20}C_3$:

| | Calc. | Found |
|---|---|---|
| % C | 72.55 | 72.41 |
| % H | 8.12 | 8.07 |

When heated alone, this compound gave a strong cinnamon odor as well as a sweet background odor.

As in Example 3, this material was applied to cigarette wrappers at the 0.5 mg/cigarette level. It gave much the same flavor character as Compound A, but significantly less intense. The substantial absence of a cinnamon note is not explained.

Compounds D, F, J and L were each separately applied, as 5% (by weight) aqueous solutions, to tobacco rods, which were then dried, equilibrated under room conditions and smoked by a panel of smokers for their description of the smoke characteristics. The following results were obtained:

When 10 ml of the solution of Compound D were employed per cigarette rod, the smoke was found to have an anise character, but to have a chemical, acrid quality as well. When 25 ml of the solution of Compound D were employed per cigarette rod, the smoke was found to be anise-like and to have a methyl charcoal flavor.

When 10 ml of the solution of Compound F were used per cigarette rod, the smoke was found to be somewhat harsh and to have no particular taste; however, when 25 ml of the solution were used, the smoke was found to have a fruity flavor and a butyric acid flavor.

When 10 ml of the solution of Compound J were used, the smoke had some harshness, but provided a "full flavor."

When 10 ml of the solution of Compound L were used, the smoke was found to be mild and aromatic, with a slight sweetness and a black pepper note.

EXAMPLE 5

Compound D was prepared as follows: 1.8 g (6.75 m mole) of the ester, Compound C (see Example 1), was refluxed for five hours with 40 ml of previously boiled water containing 1.75 g (10 m mole) of barium hydroxide. After two days at room temperature, the mixture was acidified with 10% aqueous H Cl. The precipitate was recrystallized from ethanol/water 1:3 (20 ml). Colorless plates were recovered, m. 152°-156°. A second recrystallization from ethanol/water gave 0.7 g of colorless product, which when dried 2 hours/60° under vacuum melted at 155°-158°.

Elemental analysis of this product gave these results:

| | % C | % H |
|---|---|---|
| Calcd. for $C_{12}H_{14}O5$ | 60.50 | 5.92 |
| Found | 60.82 | 5.89 |

-continued

| | % C | % H |
|---|---|---|
| Found (after further recrystallization) | 60.67 | 5.62 |

The identification of this compound was verified by MS, NMR and IR findings. Gas chromatography has shown (in conjunction with the aid of NMR) two principal products from pyrolysis of this acid. At temperatures below 350° the principal large fragment was shown to be 1,1dimethyl-2-(3,4-methyleneioxyphenyl)ethene, i.e., by loss of $CO_2$ and $H_2O$. At temperatures above 350° the principal large fragment was piperonal, through what amounts to reversal of the Reformatsky reaction.

EXAMPLE 6

Compound F was made by straightforward esterification of the corresponding acid (Compound J). In 10 ml of methanol was dissolved 1.94 g (10 m mole) of the aicd, and two drops of conc. $H_2SO_4$ were added. This was refluxed on a steam bath for 3 hours, and the methanol was then evaporated. The residue was dissolved in 10 ml of methylene chloride, and the solution washed with 5×2 ml of water until neutral. Drying with $Na_2SO_4$ and evaporation of the solvent left 1.35 g (65%) of a white crystalline compound which after recrystallization from hexane appeared as colorless needles, m.p. 68°-69.5°.

Analysis and NMR spectrum confirmed the identification as the methyl ester:

| | % C | % H |
|---|---|---|
| Calcd. for $C_{12}H_{16}O_3$ | 69.21 | 7.74 |
| Found | 69.38 | 7.72 |

Gas chromatography at an injection port temperature of 350° showed (with aid of NMR identification) the products of a reverse Reformatsky: benzaldehyde and methyl isobutyrate.

EXAMPLE 7

Compound G was prepared by a straightforward esterification of the corresponding acid, Compound J. In 15 ml of benzene were dissolved 1.32 g (15 m mole) of n-amyl alcohol, 2.91 g (15 m mole) of the acid, and 100 mg of p-toluensulfonic acid. The mixture was refluxed overnight with use of a Dean-Starke Trap for water. The solution was washed with 4×10 ml of water until washings were neutral, dried over $Na_2SO_4$, and evaporated to leave a yellow liquid. This was distilled at reduced pressure, 2.3 g $b_{.04\ mm}$ 105°-110°.

| Analysis showed: | % C | % H |
|---|---|---|
| Calcd. for $C_{16}H_{24}O_3$ | 72.69 | 9.15 |
| Found | 72.78 | 9.43 |

The results of MS, NMR and IR also confirmed the identity of the amyl ester.

What is claimed is:

1. A smoking product comprising a smoking material and from at least 0.0001 percent by weight based on said smoking material, of a beta-hydroxy ester having the formula:

-continued

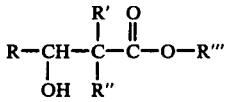

wherein R may be a member selected from the group consisting of:

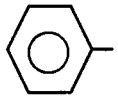

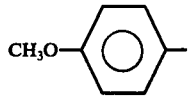

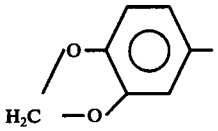

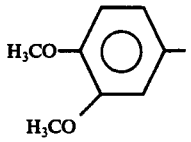

-continued

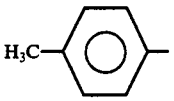

and

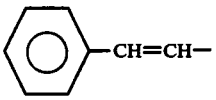

wherein R′ is a lower alkyl group, particularly methyl or ethyl; wherein R″ is a lower alkyl group, particularly methyl or ethyl; and wherein R‴ is a member selected from the group consisting of H, M, which may for example be an alkaki metal such as sodium or potassium, and alkyl containing from 1 to 8 carbon atoms, for example, methyl, ethyl, n-propyl, isopropyl, n-butyl, sec.-butyl, isobutyl, tert.butyl, n-amyl, n-hexyl, n-heptyl and n-octyl.

2. The smoking product of claim 1 wherein said smoking material is tobacco.

3. The smoking material of claim 2 wherein said compound is ethyl 2,2-dimethyl-3-hydroxy-3-phenylpropionate.

4. The smoking material of claim 2 wherein said compound is ethyl 2,2-dimethyl-3-hydroxy-3-(4′-methoxyphenyl)-propionate.

5. The smoking material of claim 2 wherein said compound is ethyl 2,2-dimethyl-3-hydroxy-3′,4′-methylenedioxyphenyl)-propionate.

* * * * *

UNITED STATES PATENT AND TRADEMARK OFFICE

CERTIFICATE OF CORRECTION

PATENT NO. : 4,036,237

DATED : July 19, 1977

INVENTOR(S) : Lina Chen Teng

It is certified that error appears in the above-identified patent and that said Letters Patent are hereby corrected as shown below:

Delete the entire drawing that appears on the title page. Column 3, line 25, the first occurrence of "of" should read --or--. The formula at Column 5, line 20, should be read as being at the right side of the equation set forth at Column 5, line 4. Column 7, line 61, "D" should read --B--. Column 12, line 31, "2,2-dimethyl-3-hydroxy-3',4'-" should read --2,2-dimethyl-3-hydroxy-3-(3',4'- --.

Signed and Sealed this

Ninth Day of May 1978

[SEAL]

Attest:

RUTH C. MASON
Attesting Officer

LUTRELLE F. PARKER
Acting Commissioner of Patents and Trademarks

UNITED STATES PATENT AND TRADEMARK OFFICE

CERTIFICATE OF CORRECTION

PATENT NO. : 4,036,237

DATED : July 19, 1977

INVENTOR(S) : Lina Chen Teng

It is certified that error appears in the above-identified patent and that said Letters Patent are hereby corrected as shown below:

In EXAMPLE 4, column 9, lines 31, 34, 38, 41, 43 and 46, "ml" should read --μl--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*